United States Patent [19]

Wang

[11] Patent Number: 5,000,706

[45] Date of Patent: Mar. 19, 1991

[54] ROCKER TYPE PROPULSION MECHANISM FOR A BOAT

[76] Inventor: June C. Wang, No. 2-1, Alley 9, Hung En 3 Lane, Sec. 3, Hsi Tun Rd., Taichung City, Taiwan

[21] Appl. No.: 424,672

[22] Filed: Oct. 20, 1989

[51] Int. Cl.[5] ..... B63H 16/16

[52] U.S. Cl. ..... 440/14; 440/24

[58] Field of Search ..... 440/14, 15, 11, 19, 440/20, 21, 24

[56] References Cited

U.S. PATENT DOCUMENTS 2,097,931 11/1937 Martin ..... 440/14
2,365,415 12/1944 Kruse ..... 440/15 X
3,090,974 5/1963 Wozniak ..... 440/24 X
3,880,107 4/1975 Miles ..... 440/14

FOREIGN PATENT DOCUMENTS 281997 1/1931 Italy ..... 440/14

*Primary Examiner*—Sherman Basinger

[57] ABSTRACT

A rocker type propulsion mechanism for a boat includes a rocker arm pivotally provided on the boat, a lever arm being laterally connected to the rocker arm for rockably actuating the rocker arm, a paddle being pivoted on an other end of the rocker arm, and a blocking device being provided beside the paddle for limiting a rotation of the paddle. A rotation of the rocker arm causes the paddle to make a relative movement with water in order to propel the boat.

6 Claims, 7 Drawing Sheets

ROCKER TYPE PROPULSION MECHANISM FOR A BOAT

FIELD OF THE INVENTION

The present invention relates to a propulsion mechanism for a boat, and more particularly to a rocker type propulsion mechanism for a boat or the like.

BACKGROUND OF THE INVENTION

Conventional boats are propelled by such means as propellers, oars, paddles or the like. Propellers require an electric or mechanicl power system to drive them, and are thus not good for exercising purposes. Rowing a boat with paddles or oars requires a certain amount of training, which is time consuming and not highly entertaining.

Therefore, the present invention has arisen to provide a propulsion mechanism for a boat which has a totally different configuration compared with prior propulsion mechanisms for boats.

SUMMARY OF THE INVENTION

The primary objective of the present invention is to provide a propulsion mechanism for a boat, which can be manually actuated to rock, to propel the boat for exercising, competitive or entertainment purposes.

Another objective of the present invention is to provide a propulsion mechanism for a boat which can be automatically actuated to rock to propel a toy boat for increasing the entertainment effects.

Further objectives and advantages of the present invention will become apparent from a careful reading of the detailed description provided hereinbelow, with appropriate reference to the accompanyiung drawings.

DETAILED DESCRIPTION OF THE INVENTION

Figure 1:
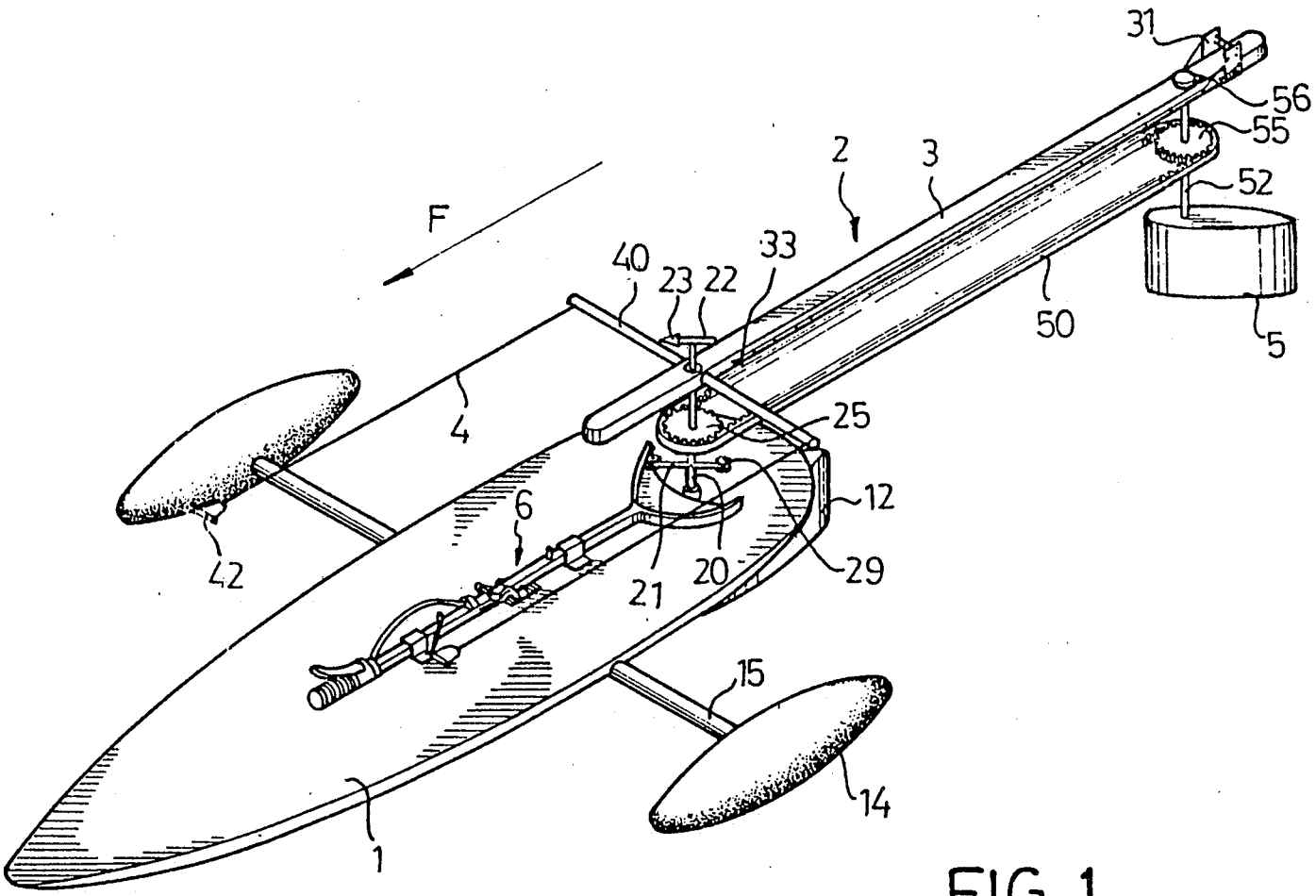
FIG. 1 is a perspective view of a rocker type propulsion mechanism for a boat in accordance with the present invention.
Figure 2:
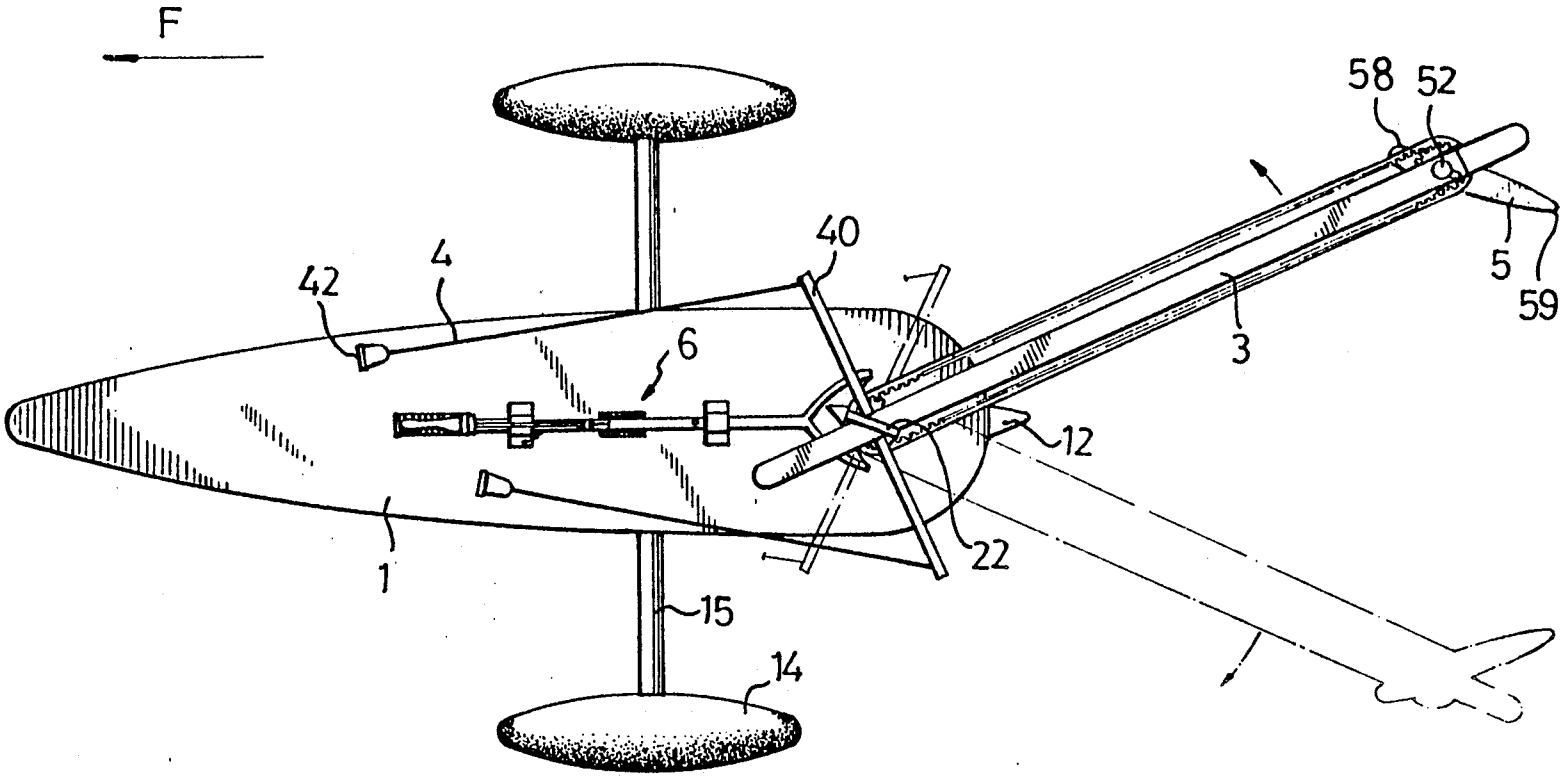
FIG. 2 is a top view of the rocker type propulsion mechanism for the boat of FIG. 1.
Figure 3:
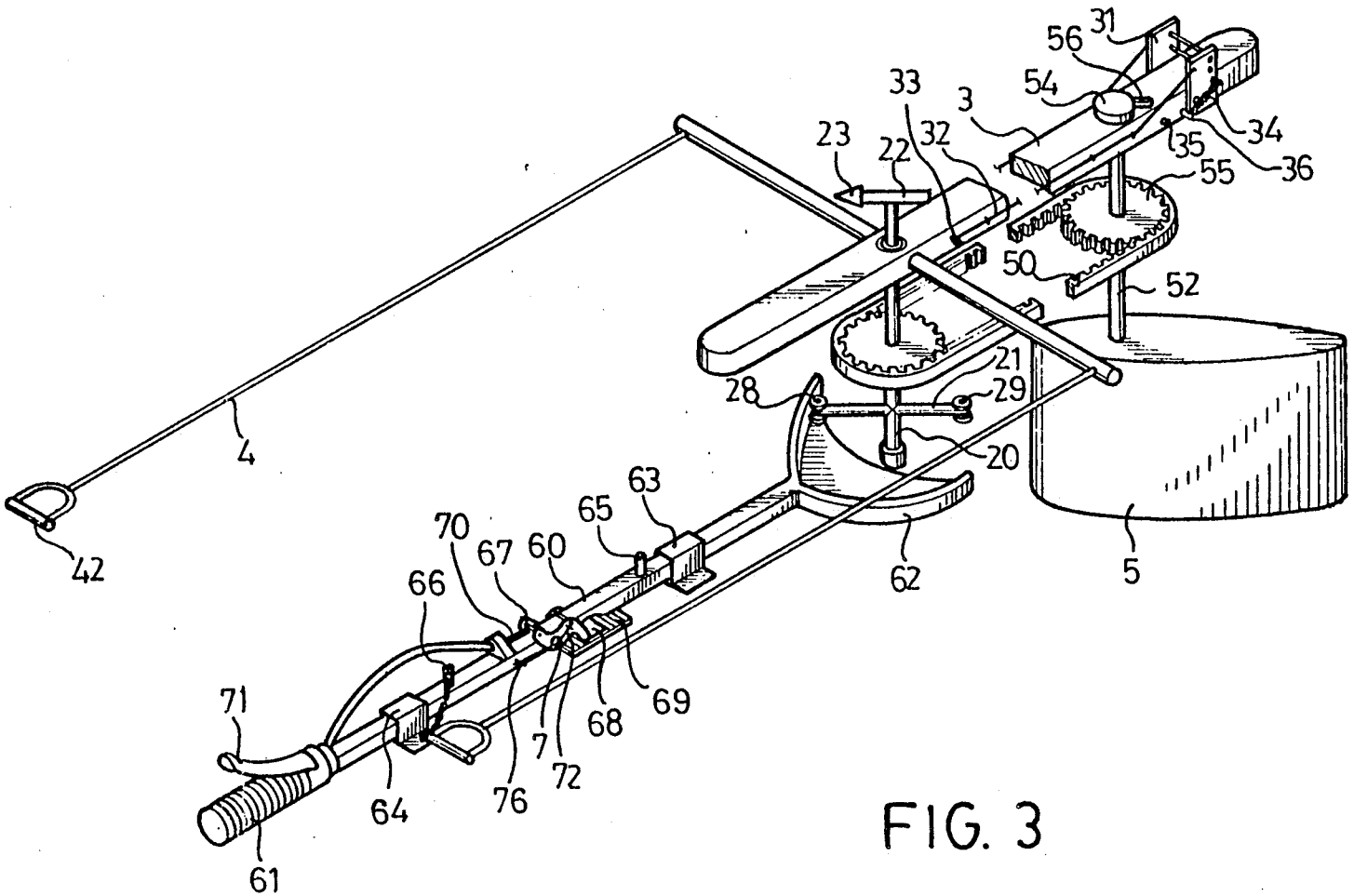
FIG. 3 is an enlarged partial perspective view of the rocker type propulsion mechanism and an angle adjustment device for the boat of FIG. 1.

Referring to the drawings and initially to FIGS. 1, 2 and 3, the rocker type propulsion mechanism for a vessel or a boat in accordance with the present invention is provided on a boat body 1 substantially at a rear end thereof. The arrow F shows the forward direction of the boat body 1 and is hereinafter referred to as the forward direction of all the parts mentioned in this specification. A fin or a rudder 12 is provided at a rear end of the boat body 1 for controlling the moving direction of the boat body 1. A pair of floats 14 are disposed on both sides of the boat body 1 by an extension rod 15 for increasing the stability of the boat body 1.

The propulsion mechanism 2 generally comprises a post 20 vertically pivoted at the rear end of the boat body 1, a rocker arm 3 with one end pivoted on the post 20, a pair of pulling cables 4 for actuating the rocker arm 3, a paddle 5 pivoted at a rear end of the rocker arm 3, and an angle adjustment device 6.

The post 20 is pivoted on an upper surface of the boat body 1. A lateral pin 21 is integrally disposed on the post 20 at a lower end thereof, and a pointer 22 is integrally disposed on top of the post 20. A tip 23 of the pointer 22 is generally arrow shaped for indicating the direction of the paddle 5. Two end balls or protuberances 28, 29 are provided on both ends of the lateral pin 21. A respective front end of the rocker arm 3 is pivoted on the post 20 between the lateral pin 21 and the pointer 22 so that the rocker arm 3 is freely rotatable about the post 20. A lever arm 40 is substantially perpendicular and integrally connected to the rocker arm 3. The lever arm 40 is preferably perpendicular to the post 20. A pair of pulling cables 4 are connected at both ends of the lever arm 40. A pulling ring or a foot pedal 42 is provided at each free end of the pulling cables 4 for rockably swinging the rocker arm 3 via the lever arm 40. A paddle shaft 52 with an enlarged head 54 is pivoted at the rear end of the rocker arm 3 for connecting the paddle 5 at a lower end thereof. The paddle 5 is substantially airfoil shaped. An extension 56 which is preferably parallel to the paddle 5 is integrally connected to the enlarged head 54 of the paddle shaft 52. A pair of gears 25, 55, of which the sizes are substantially the same, are integrally fixed on the respective post 20 and the paddle shaft 52 with a chain or a belt 50 coupling therebetween so that the two gears 25, 55, and in turn the post 20 and the paddle shaft 52 move correspondingly.

Figure 7:
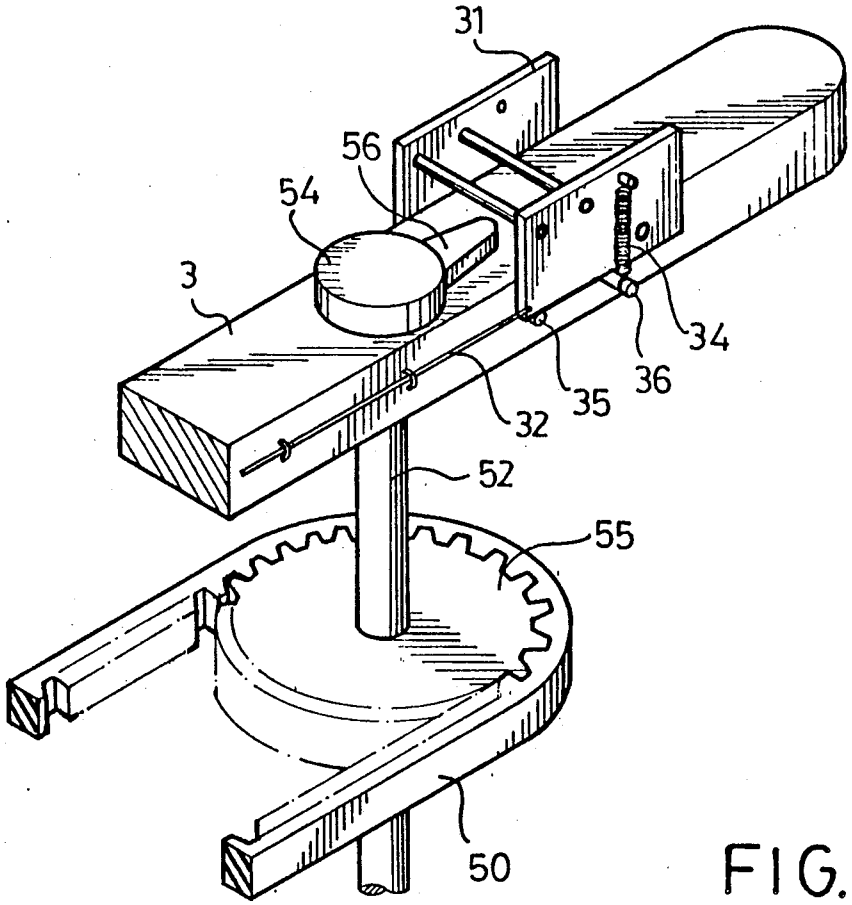
FIG. 7 is a partial perspective view of an auxiliary apparatus for controlling the rotation of the paddle instead of the angle adjustment device.

A pair of baffle plates 31 are symmetrically pivoted on both sides of the roker arm 3. A cable 32 has one end thereof connected to a front and upper corner of one of the baffle plates 31, and the other end to a pin 33 which is removably pinned to the relative front end of the rocker arm 3. A spring element 34 has one end thereof connected to a rear, middle position of one baffle plate 31, and the other end to a pin 36 which is fixed on the rocker arm 3 as shown in FIGS. 3 and 7. The function of the baffle plates will be described in detail hereinafter.

Referring again to FIG. 3, the angle adjustment device 6 includes generally a beam 60 with a handle 61 at a front end thereof and with a substantially Y-shaped guide portion 62 at a rear end. The branches of the guide portion 62 have smooth and curved inner surfaces for contacting the end balls 28, 29 of the lateral pin 21. The beam 60 is slidably held by a pair of holding frames 63, 64 which are fixed on the boat body 1. A stop pin 65 and a safety pin 66 are pinned on the beam 60 between the two holding frames 63, 64, in which the stop pin 65 is closer to the Y-shaped guide portion 62 and the safety pin 66 is closer to the handle 61. A clutch element 67 with a clutch facing 68 is pivoted on the beam 60 at pivot axle 7 between the two pins 65, 66, in which the clutch facing 68 faces downward and frictionally contacts a clutch lining 69 which is fixed on the boat body 1. A center portion of a spring element 72 is fixed on the pivot axle 7. One end of the spring element 72 is attached to a pin 76 which is fixed on the beam 60 and the other end is attached to a pin 74 which is fixed on the clutch element 67 so that the clutch facing 68 is pressed downdard by the spring element 72. A cable 70 is connected between the clutch element 67 and a clutch handle 71 which is pivoted on one end of the handle 61 so that the clutch handle 71 can pull the clutch facing 68 up, and the angle adjustment device 6 can move freely. When the clutch handle 71 is released, the spring element 72 presses the clutch facing 68 downward again.

Figure 4:
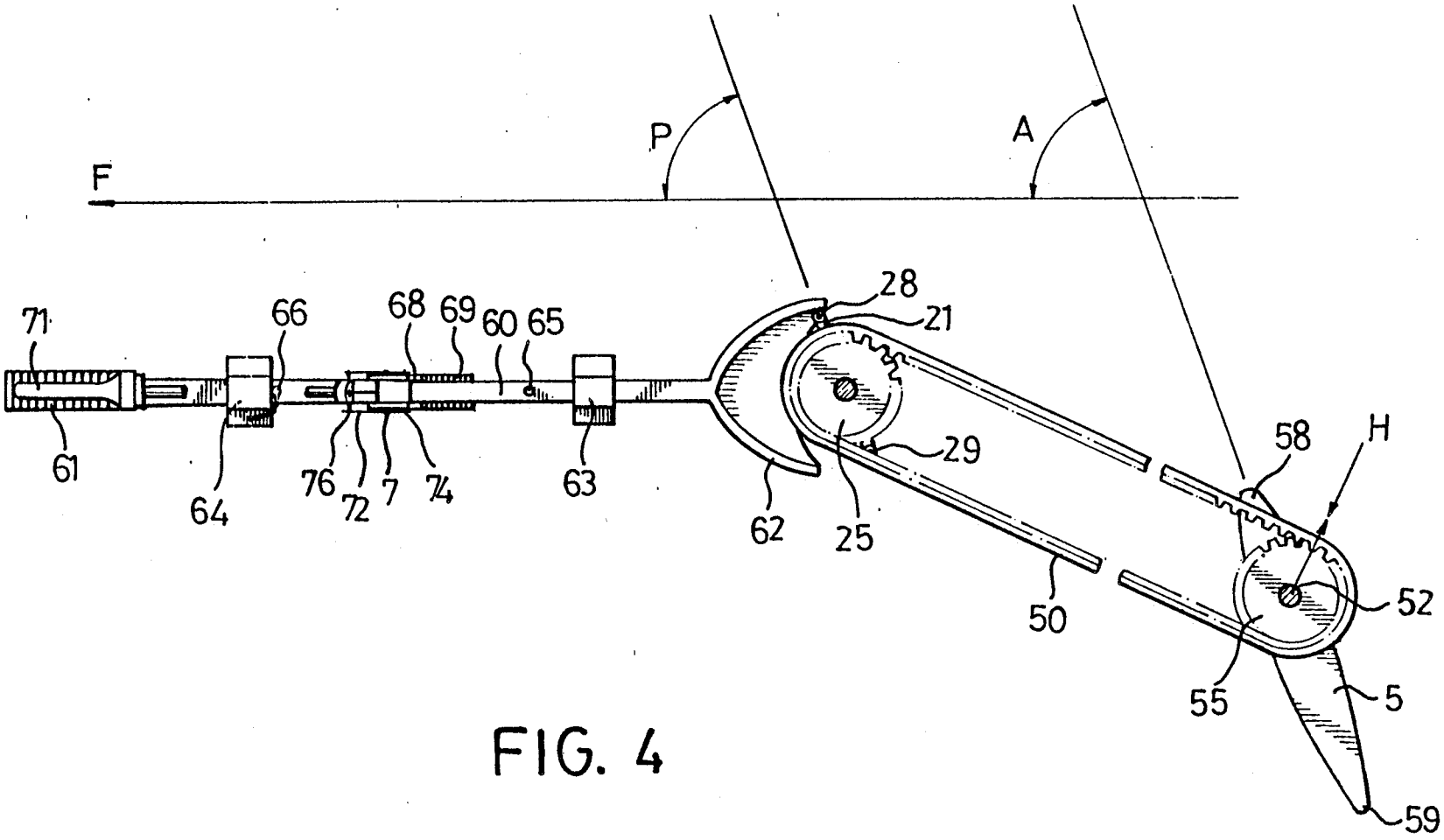
FIG. 4 is a schematic plan view illustrating the adjustment of the propulsion mechanism.
Figure 5:
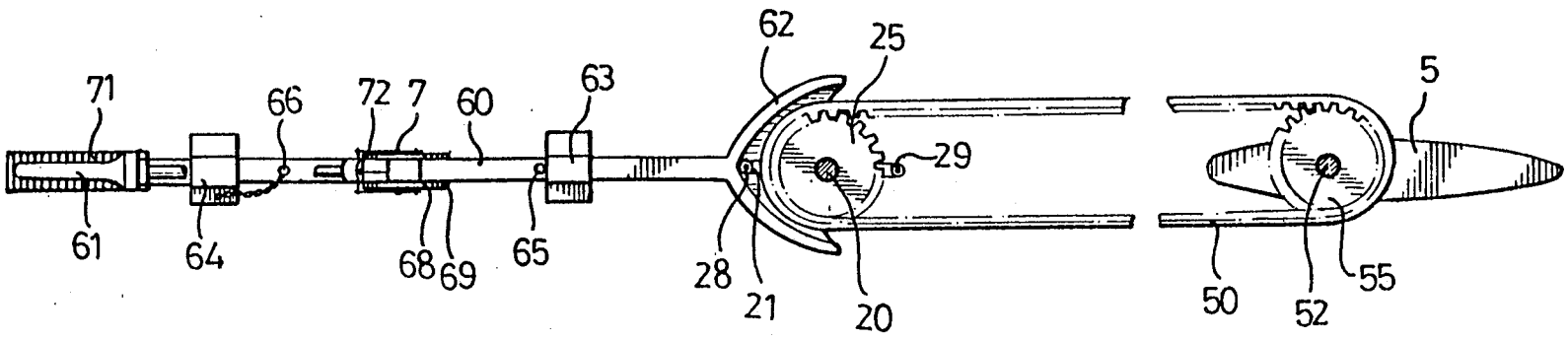
FIG. 5 is a schematic plan view similar to FIG. 4, illustrating a rest position of the propulsion mechanism.

Referring next to FIGS. 4 and 5, illustrated is the adjustment of an angle A of the paddle 5. As shown in FIG. 4, the angle adjustment device 6 is pulled to the forwardmost position where the safety pin 66 touches the frame 64. The adjustment can be carried out by pressing down the clutch handle 71 to separate the clutch facing 68 and the clutch lining 69, and releasing the clutch handle 71 when reaching the desired position. At this position, the end ball 28 of the lateral pin 21 contacts the outer end of the guide portion 62 and the movement of the end ball 28 is limited between the brances of the guide portion 62. An angle P between the arrow F and the longitudinal axis of the lateral pin 21 is the largest at this moment. The tip 23 of the pointer 22 indicates the direction of the paddle 5 and also the direction of the lateral pin 21.

The angle A between an extension line of the arrow F and the camber line of the paddle 5 equals the angle P, which means that the lateral pin 21 and the paddle 5 rotate correspondingly by means of the chain or belt 50. When the angle adjustment device 6 is pushed rearward, the end ball 28 slides along the inner surface of the guide portion 62 until the angle adjustment device 6 is pushed to the rearmost position where the stop pin 65 touches the frame 63, as shown in FIG. 5. At the position where the camber line of the paddle 5 is parallel to the moving direction F of the boat body 1, the end ball 28 lies at the root position of the guide portion 62 of the angle adjustment device 6. At this moment, the drag force of the paddle 5 is the lowest.

Referring again to the drawings and particularly to FIGS. 2, 3 and 4, the rocker arm 3 is actuated to swing by pulling the two cables 4 alternatively. It is to be noted that the distance between a leading edge 58 of the paddle 5 and the paddle shaft 52 is shorter than the distance between a trailing edge 59 of the paddle 5 and the paddle shaft 52. Obviously, the surface area of the rear part (closer to the trailing edge 59) of the paddle 5 is larger than the surface area of the front part of the paddle 5. When the rocker arm 3 swings counterclockwise, as shown in FIG. 4 and as shown in solid lines in FIG. 2, the paddle 5 is forced to rotate clockwise about the paddle shaft 52 because the rear part of the paddle 5, which has the larger surface area, sustains more hydraulic force than the front part of the paddle 5. As soon as the paddle 5 rotates clockwise, the lateral pin 21 is actuated to rotate by the belt 50 until the end ball 28 touches the guide portion 62. It is to be noted that the rotation of the paddle 5 and the rotation of the lateral pin 21 are dependent, but the rotation of the paddle 5 and the swinging of the rocker arm 3 are independent. A further clockwise rotation of the paddle 5 and the lateral pin 21 is limited by the guide portion 62 so that the angle A of the paddle 5 remains unchanged when the rocker arm 3 swings counterclockwise. A component of the relative hydraulic force applied on the paddle 5, which is designated by arrow H in FIG. 4, pushes against the paddle 5 and urges the boat body 1 forward in the direction of the arrow F. The larger the angle A obtained, the slower the boat body 1 moves, because the effective component of the relative hydraulic force H for pushing the paddle 5 and the boat body 1 is smaller when the angle A of the paddle 5 is larger. Once the rocker arm 3 is actuated to swing clockwise, the paddle 5 is forced to rotate counterclockwise rapidly, as shown in dotted lines in FIG. 2, so that the end ball 28 rotates and contacts the other end of the guide portion 62 rapidly. The angle A of the paddle 5 is also kept constant whenever the rocker arm 3 swings clockwise. The moving directions of the boat can be controlled by swinging the paddle 5 on one side of a longitudinal axis of the boat body 1.

Referring next to FIGS. 3 and 4, when the clutch handle 71 is pressed to separate the clutch facing 68 from the clutch lining 69, the guide portion 62 can be pushed toward the lateral pin 21, then, the end ball 28 is forced to slide along the inner surface of the guide portion 62 until the end ball 28 reaches the desired angle A. By releasing the clutch handle 71, the clutch facing 68 contacts the clutch lining 69 so that the angle A of the paddle 5 is fixedly adjusted depending on the energy of each user, and on the desired speed of the boat.

Figure 6:
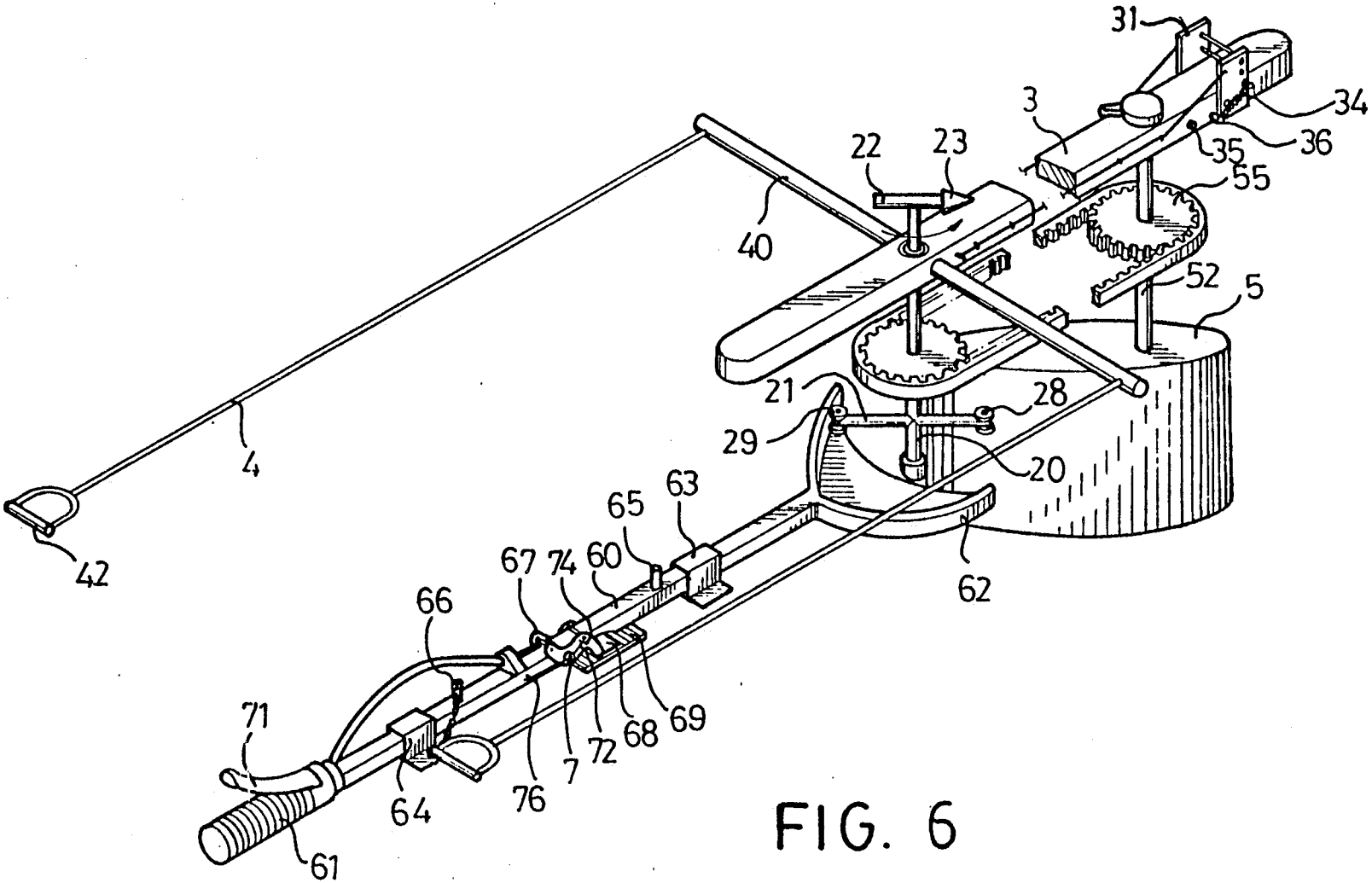
FIG. 6 is a partial perspective view of the propulsion mechanism and the angle adjustment device which illustrates the adjustment of the paddle for backward sailing of the boat.

Referring next to FIG. 6, the direction of the paddle 5 can be inverted by removing the safety pin 66 and pulling the guide portion 62 away from the lateral pin 21 so that the lateral pin 21 can be rotated by the user until the end ball 29 is located between the branches of the guide portion 62. The guide portion 62 is pushed forward again to limit the rotation of the lateral pin 21. Therefore, the paddle 5 and the boat body 1 can be urged to move in a direction opposite to the arrow F when the rocker arm 3 is rockably actuated. The pointer 22 also shows the direction of the paddle 5. Accordingly, the rocker type propulsion mechanism can be disposed either at the front end or at the rear end of the boat body 1, the moving direction of the boat can be present by setting the paddle 5 at a predetermined direction.

Referring now to FIG. 7, illustrated is an auxiliary apparatus for controlling the angle A of the paddle 5 instead of the guide portion 62 of the angle adjustment device 6. When the belt 50 is broken in accident, for example, the paddle 5 rotates freely so that the boat can not be propelled. Under such circumstances, the pair of baffle plates 31 can be pulled down by removing the pin 33 and pulling the cable 32 until the baffle plates 31 contact a pin 35 so that the extension 56 is confined between the two baffle plates 31. The spring element 34 constantly pulls the baffle plates 31 downward into position so that the baffle plates 31 take the place of the guide portion 62 of the angle adjustment device 6. Therefore, the rotation of the paddle 5 can be controlled by the auxiliary apparatus instead of the Y-shaped guide portion 62 of the angle adjustment device 6. Alternatively, a fixed Y-shaped guide portion 62 or a pair of stop plates which are fixed on the boat body 1 can be used to limit the rotation of the paddle 5. Further alternatively, the rotation of the paddle 5 is controlled directly by a blocking device, such as a pair of extensions either protruded from the rocker arm 3 or protruded from the paddle 5, instead of limiting the rotation of the extension 56.

Referring again to FIGS. 1 and 2, the pulling rings or foot pedals 42 can be designed so that the user can either pull or push the pulling rings 42 with the hands, or push the foot pedals 42 with the feet. Therefore, when pushing the pulling rings 42 with the hands and the foot pedals 42 with the feet, the user faces toward the direction of the arrow F. On the contrary, when the user pulls the pulling rings 42, the user faces toward the direction opposite to the arrow F. Alternatively, the cables 4 can be pulled by a powered mechanism (not shown), such as a motor so that the user does not need to pull the cables 4. This propulsion mechanism is particularly suitable for a toy boat. In addition, a pair of foot pedals (not shown) can also be disposed on both ends of the lever arm 40 so that the lever arm can be directly actuated by a user's feet.

Alternatively, the end of the rocker arm 3 which is opposite to the end bearing the paddle 5 is actuated to swing directly by one or more users without utilizing the lever arm 40. It is to be noted that the rocker arm 3 and the post 20 can be provided on the upper surface or below the bottom surface of the boat. The boat or the vessel utilizing the propulsion mechanism in accordance with the present invention is also useful for moving under the water, like a submarine.

Accordingly, the present invention provides a totally different configuration of the propulsion mechanism for the boat, which greatly increases the exercising and entertainment effects. The present invention is also suitable for competition.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rocker type propulsion mechanism for a boat comprising a post being vertically pivoted on a boat body, a rocker arm being pivoted by one end on said post and rotatable in a plane which is substantially parallel to said boat body; a paddle being pivoted on an other end of said rocker arm; and a blocking means being provided to limit a rotation of said paddle; said blocking means comprising a transmission mechanism coupling said post and a pivot axle of said paddle so that said post and said paddle rotate correspondingly, and guide means being provided beside a lateral extension of said post for limiting a rotation said lateral extension and said paddle; a rotation of said rocker arm causing said paddle to make a relative movement with water in order to propel said boat body.

2. A propulsion mechanism according to claim 1, wherein said transmission mechanism includes a first gear fixed on said post, a second gear fixed on said pivot axle of said paddle and a coupling element coupling said first and said second gears.

3. A propulsion mechanism according to claim 1, wherein said guide means is substantially Y-shaped and is fixed on said boat body.

4. A propulsion mechanism according to claim 1, wherein said guide means is generally a shaft with a Y-shaped guide portion formed at one end thereof, said shaft is slidably provided on said boat body so that said Y-shaped guide portion is movable closer to or away from said lateral extension of said post.

5. A propulsion mechanism according to claim 4, wherein a pair of ball elements are provided on both ends of said lateral extension of said post for facilitating a contact between said lateral extension and said Y-shaped guide portion.

6. A propulsion mechanism according to claim 4, wherein a clutch facing is provided on said shaft and a clutch lining is provided on said boat body, said clutch facing and said clutch lining are contactable in order to prevent a sliding of said shaft; and a clutch handle with a cable is pivoted on one end of said shaft for pulling said clutch facing in order to control a contact between said clutch facing and said clutch lining thus adjusting a sliding of said guide means.

* * * * *